US006905311B2

(12) United States Patent
Leathart

(10) Patent No.: US 6,905,311 B2
(45) Date of Patent: Jun. 14, 2005

(54) FAN BLADE ASSEMBLY

(75) Inventor: Paul A Leathart, Alvaston (GB)

(73) Assignee: Rolls-Royce plc, London (GB)

( * ) Notice: Subject to any disclaimer, the term of this patent is extended or adjusted under 35 U.S.C. 154(b) by 0 days.

(21) Appl. No.: 10/607,187

(22) Filed: Jun. 27, 2003

(65) Prior Publication Data

US 2004/0013528 A1 Jan. 22, 2004

(30) Foreign Application Priority Data

Jul. 20, 2002 (GB) ..... 0216951

(51) Int. Cl.[7] ..... F01D 5/16
(52) U.S. Cl. ..... 416/221; 416/500
(58) Field of Search ..... 416/221, 500

(56) References Cited

U.S. PATENT DOCUMENTS 3,597,112 A * 8/1971 Garten ..... 416/205
4,474,535 A 10/1984 Dhuic
4,478,554 A 10/1984 Surdi
5,236,309 A * 8/1993 Van Heusden et al. ..... 416/221

FOREIGN PATENT DOCUMENTS

EP 0 597 586 A 5/1994
EP 0 690 203 A 1/1996
GB 1 533 564 SP 11/1978
GB 2 021 206 A 11/1979
GB 2 038 959 A 7/1980

* cited by examiner

*Primary Examiner*—Ninh H. Nguyen
(74) *Attorney, Agent, or Firm*—W. Warren Taltavull; Manelli Denison & Selter PLLC

(57) ABSTRACT

A fan blade assembly (24) comprises a fan rotor (28) and a plurality of radially extending fan blades (30). The periphery (38) of the fan rotor (28) has a plurality of axially extending slots (40). Each of the fan blades (30) has a root portion (42), which locates in one of the slots (40) in the fan rotor (28). Each slot (40) has a slider member (50), which is locatable between the fan blade (30) root portion (42) and the bottom (31) of the slot (40). Each slot (40) has a spring (52), which is locatable between the fan blade (30) root portion (42) and the slider member (50). Each slot (40) has a wedge (54), which is locatable between the slider member (50) and the spring (52). The wedge (54) is movable axially between a first position in which the wedge (54) moves the spring (52) radially outwardly into engagement with the fan blade (30) root portion (42) to at least reduce vibration of the fan blade (30) and a second position in which the wedge (54) allows the spring (52) to move radially inwardly to allow assembly or disassembly of the fan blade (30).

17 Claims, 3 Drawing Sheets

FAN BLADE ASSEMBLY

FIELD OF THE INVENTION

The present invention relates to a fan blade assembly for a turbofan gas turbine engine, and relates in particular to the manner in which the fan blades are mounted in the fan rotor to prevent movement of the fan blades during windmilling of the fan blade assembly.

BACKGROUND OF THE INVENTION

The fan assembly of a turbofan gas turbine engine comprises a fan rotor having a plurality of generally axially extending slots in its periphery, which receive the root portions of the fan blades. The slots and fan blade root portions are of corresponding generally dovetail cross-section shape so as to ensure radial retention of the fan blades.

Our European patents EP0597586B1 and EP0690203B1 disclose a fan blade assembly of a turbofan gas turbine engine in which the fan blade root portions and the axially extending slots are provided with generally radially extending slots. The radially extending slots in each fan blade root portion are aligned with the radially extending slots in the corresponding axially extending slot in the periphery of the fan rotor. A U-shaped key is located in each of the sets of aligned radially extending slots to lock the fan blade root portions in position. Each key is provided with a spring to bias the key into the aligned radially extending slots and each key is moved against the spring and out of the radially aligned slots to allow the fan blade root portion to be moved axially for assembly or disassembly of the fan blades on the fan rotor. Locking means are provided in the axially extending slots between the fan blade root portions and the bottoms of the axially extending slots to lock the keys in position in the aligned radially extending slots. Additionally rubber pads are provided between the locking means and the bottoms of the axially extending slots to provide a tight, vibration free fit for the locking means and to prevent movement of the fan blades in the axial and tangential directions of the fan blade assembly during windmilling of the fan blade assembly.

In a variation of this arrangement springs are provided between the locking means and the bottoms of the fan blade root portions to provide a tight, vibration free fit for the locking means and to prevent movement of the fan blades during windmilling of the fan blade assembly.

The fan blade root portions and the springs between the locking means and the fan blade root portions are provided with wear resistant coatings to reduce wear or fretting.

These arrangements have proved satisfactory for turbofan gas turbine engines for fan blade assemblies with current sizes of fan blades.

There is a requirement for turbofan gas turbine engines with fan blade assemblies with larger, longer, and heavier fan blades.

However, the use of the existing arrangements is unsatisfactory because the forces required to prevent movement of the fan blades during windmilling of the fan blade assembly are too high to allow assembly and disassembly of the fan blades into the fan blade assembly and/or if the fan blades are assembled into the fan blade assembly the wear resistant coatings on the springs and fan blade root portions are rubbed off.

SUMMARY OF THE INVENTION

Accordingly the present invention seeks to provide a novel fan blade assembly, which reduces, preferably overcomes, the above-mentioned problems.

Accordingly the present invention provides a fan blade assembly comprising a fan rotor and a plurality of circumferentially spaced radially extending fan blades, the fan rotor having a plurality of circumferentially spaced axially extending slots in the periphery of the fan rotor, each of the fan blades having a root portion which locates in one of the plurality of axially extending slots in the periphery of the fan rotor, each axially extending slot having a respective one of a plurality of slider members, each slider member being locatable between the fan blade root portion and the bottom of the axially extending slot, each axially extending slot having a respective one of a plurality of biasing means, each biasing means being locatable between the fan blade root portion and the slider member, each axially extending slot having a respective one of a plurality of wedges, each wedge being locatable between the slider member and the biasing means, each wedge being movable axially between a first position in which the wedge moves the biasing means radially outwardly into engagement with the fan blade root portion to at least reduce vibration of the fan blade and a second position in which the wedge allows the biasing means to move radially inwardly to allow assembly or disassembly of the fan blade.

Preferably each wedge and respective slider member have guide means to guide the axial movement of the wedge.

Preferably the guide means comprises at least one slot in the slider member and at least one projection on the wedge.

Preferably the guide means comprises two parallel slots in the slider member and two projections on the wedge.

Preferably each wedge comprises a first surface at a first end of the wedge, a second surface at the second end of the wedge, the second surface is arranged parallel to the first surface and a third inclined surface connects the first flat surface and the second surface.

Preferably each slider member comprises an axially extending groove and each biasing means locates in the axially extending groove in the respective slider member.

Preferably each biasing means comprises a spring.

Preferably each spring comprises a leaf spring.

Preferably a first end of each slider member comprises a radial projection, which abuts against the fan rotor.

Preferably the first end of each wedge comprises a radial projection, which abuts against the first end of the respective slider member.

Preferably the first end of each wedge has means to allow the wedge to be removed from the fan blade assembly.

Preferably the first end of each slider member has means to allow the slider member to be removed from the fan blade assembly.

Preferably each of the fan blade root portions and its respective axially extending slot being provided with generally radially extending slots, each radially extending slot in the axially extending slot in the fan rotor being aligned with a corresponding radially extending slot in the fan blade root portion, key means being provided to locate in the aligned radially extending slots, biasing means being positioned to bias the key means into a first position in which it locates in the aligned radially extending slots to prevent relative axial movement between the fan blade root portions and the fan rotor from a second position in which the key means does not prevent such relative axial movement, whereby retention of the key means in second position permits axial assembly and disassembly of the each of the fan blade root portions and its corresponding axially extending slot in the periphery of the fan rotor, the slider member being provided to selectively lock each of the keys in the first position in the aligned radially extending slots.

Preferably the key means is of generally U-shaped configuration, the arms of the U-shaped key means locating in the aligned radially extending slots.

Preferably one of the biasing means is attached to each of the fan blade root portions to maintain the associated key means in position on the fan blade upon removal of the fan blade from the fan rotor.

Preferably the biasing means comprises a leaf spring.

Preferably the biasing means is formed from spring steel or rubber.

BRIEF DESCRIPTION OF THE DRAWINGS

The present invention will be more fully described by way of example with reference to the accompanying drawings in which.

DETAILED DESCRIPTION OF THE INVENTION

Figure 1:
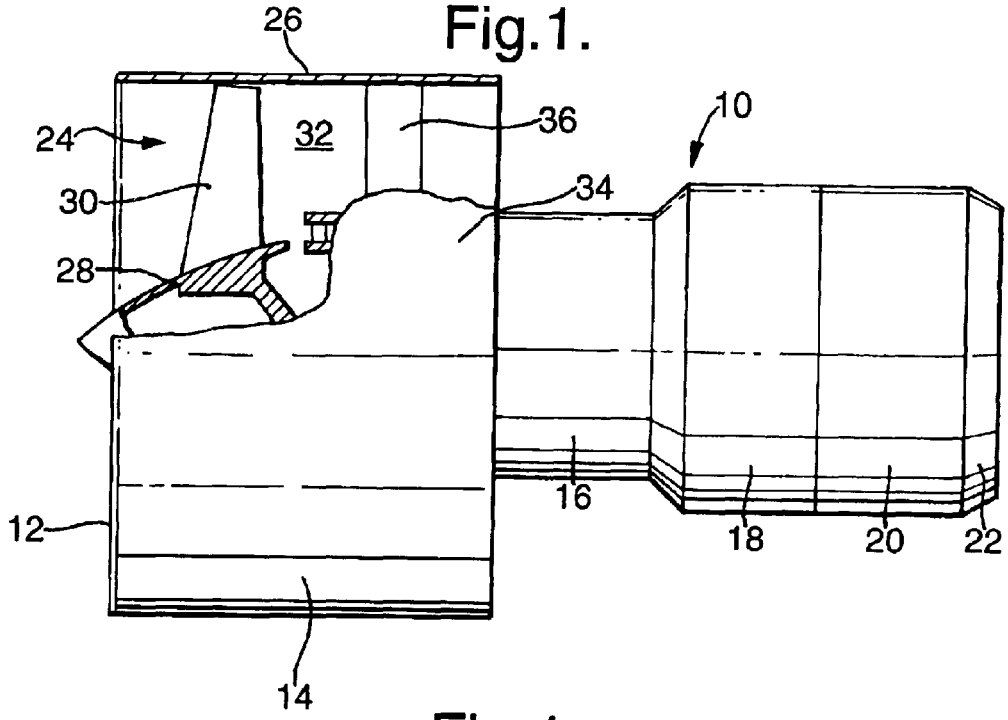
FIG. 1 shows a turbofan gas turbine engine having a fan assembly according to the present invention.

A turbofan gas turbine engine 10, as shown in FIG. 1, comprises an intake 12, a fan section 14, a compressor section 16, a combustion section 18, a turbine section 20 and an exhaust 22. The fan section 14 comprises a fan blade assembly 24 and a fan casing 26 surrounding the fan blade assembly 24. The fan blade assembly 24 comprises a fan rotor 28 and a plurality of circumferentially spaced radially outwardly extending fan blades 30 secured to the fan rotor 28. The fan casing 26 defines a fan duct 32 and the fan casing 26 is secured to a core engine casing 34 by a plurality of circumferentially spaced radially extending fan outlet guide vanes 36.

The fan blade assembly 24 is shown more clearly in figures 2, 3, 4 and 5. The fan rotor 28 comprises a plurality of circumferentially spaced axially extending slots 40 in the periphery 38 of the fan rotor 28. Each of the fan blades 30 comprises a root portion 42 and an aerofoil portion 44 and the aerofoil portion 44 has a leading edge 46 and a trailing edge 48.

Figure 4:
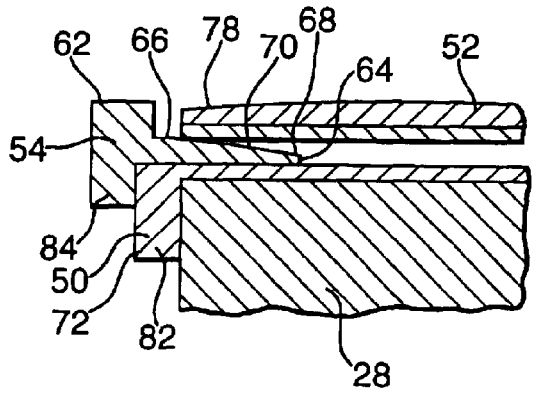
FIG. 4 is a further enlarged cross-sectional view of the spring, wedge and slider member of the fan assembly shown in FIG. 2 showing the wedge in a first position.
Figure 5:
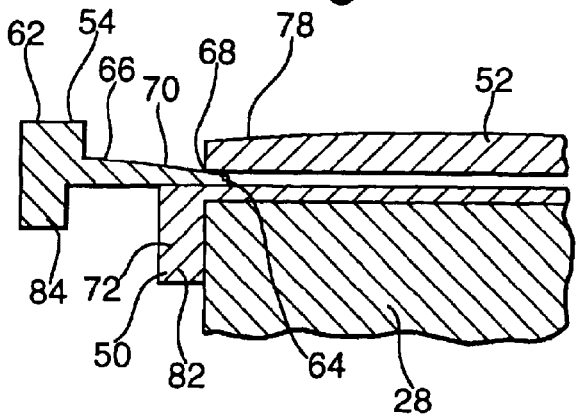
FIG. 5 is a further enlarged cross-sectional view of the spring, wedge and slider member of the fan assembly shown in FIG. 2 showing the wedge in a second position.
Figure 2:
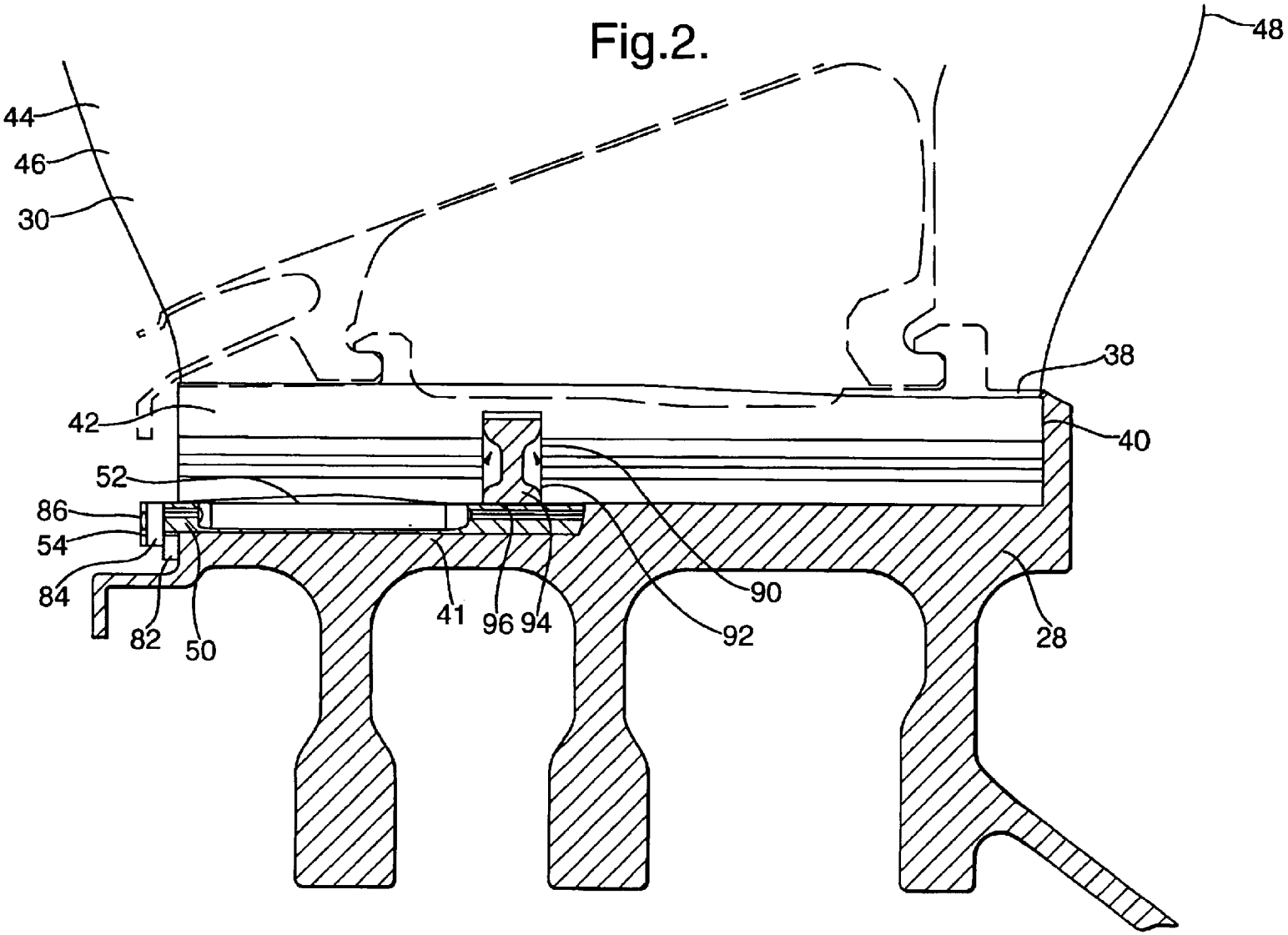
FIG. 2 is an enlarged cross-sectional view through the fan assembly according to the present invention shown in FIG. 1.

The root portion 42 of each fan blade 30 locates in one of the plurality of axially extending slots 40 in the periphery 38 of the fan rotor 28. Each axially extending slot 40 has a respective one of a plurality of slider members 50 and each slider member 50 is locatable radially between the fan blade 30 root portion 42 and the bottom 41 of the respective axially extending slot 40. Each axially extending slot 40 has a respective one of a plurality of biasing means 52 and each biasing means 52 is locatable radially between the fan blade 30 root portion 42 and the slider member 50. Each axially extending slot 40 has a respective one of a plurality of wedges 54 and each wedge 54 is locatable radially between the respective slider member 50 and the respective biasing means 52. Each wedge 54 is movable axially between a first position, as shown in FIG. 4, in which the wedge 54 moves the biasing means 52 radially outwardly into engagement with the fan blade 30 root portion 42 to at least reduce vibration of the fan blade 30 and a second position, as shown in FIG. 5, in which the wedge 54 allows the biasing means 52 to move racially inwardly to allow assembly or disassembly of the fan blade 30 into the slot 40 of the fan rotor 28.

Figure 3:
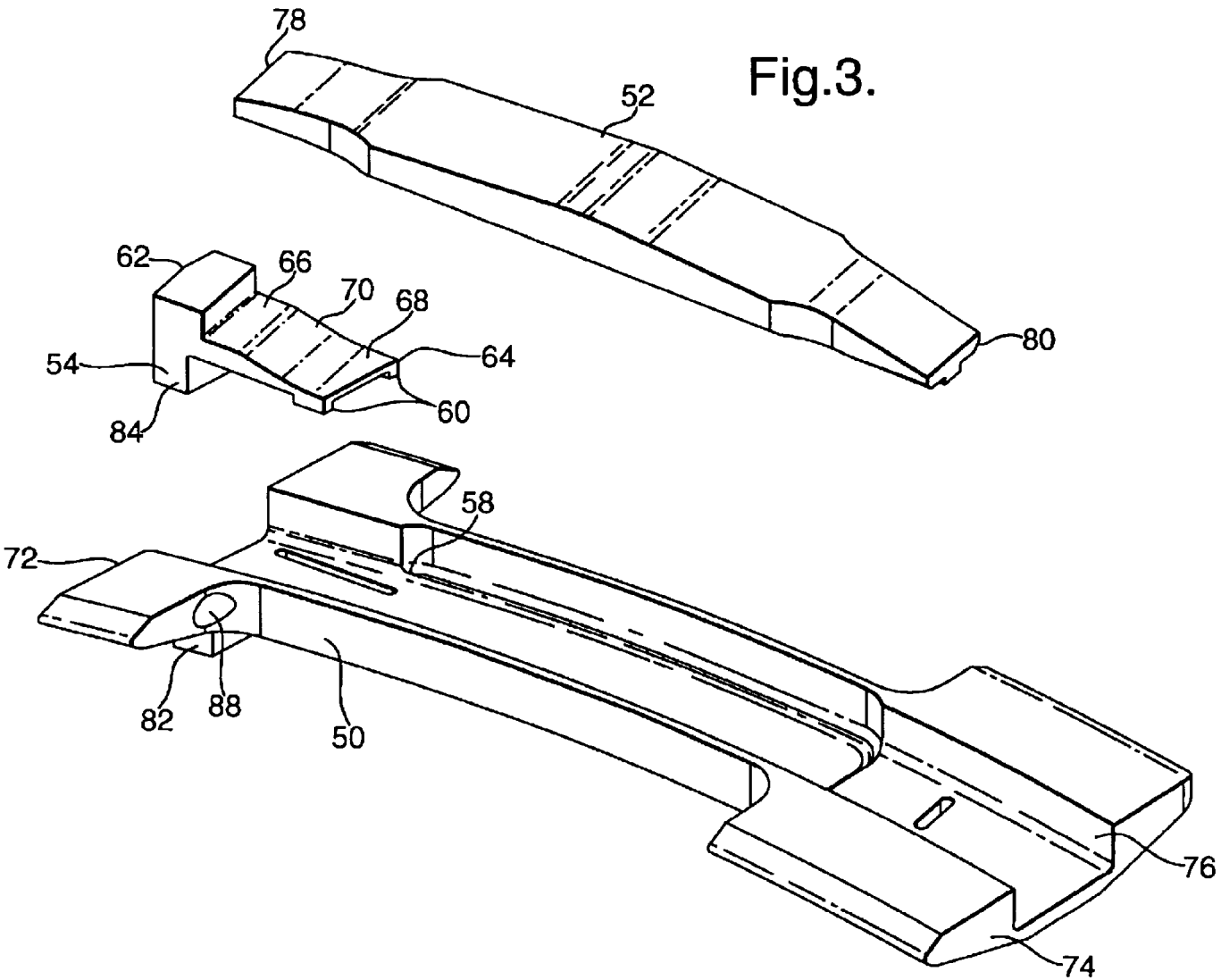
FIG. 3 is an enlarged exploded view of the spring, wedge and slider member of the fan assembly according shown in FIG. 2.

Each wedge 54, as shown more clearly in FIG. 3, has a first end 62 and a second end 64 and each wedge 54 comprises a first flat surface 66 at a first end 62 of the wedge 54, a second flat surface 68 at a second end 64 of the wedge 54 and a third inclined surface 70. The second flat surface 68 is arranged parallel to the first flat surface 66 and the third inclined surface 70 connects the first flat surface 66 and the second flat surface 68. The first end 62 of each wedge 54 has means to allow the wedge 54 to be removed from the fan blade assembly 24. The means to allow the wedge 54 to be removed comprises an axially extending threaded aperture 86 in the first end 62 of the wedge 54. The first end 62 of each wedge 54 comprises a radial projection 84, which in use abuts against the first end 82 of the respective slider member 50.

Each slider member 50, as shown more clearly in FIG. 3, has a first end 72 and a second end 74 and each slider member 50 comprises an axially extending groove 76, which extends from the first end 72 to the second end 74. Each biasing means 52 locates in the axially extending groove 76 in the respective slider member 50. The first end 72 of each slider member 50 comprises a radial projection, which in use abuts against the fan rotor 28. The first end 72 of each slider member 50 has means to allow the slider member 50 to be removed from the fan blade assembly 24. The means to allow the slider member 50 to be removed comprises an axially extending threaded aperture 88 in the first end 72 of the slider member 50.

Each wedge 54 and respective slider member 50 have guide means to guide the axial movement of the wedge 54. The guide means comprises at least one slot 58 in the slider member 50 and at least one projection 60 on the wedge 54. In this particular arrangement the guide means comprises two parallel slots 58 in the slider member 50 and two parallel projections 60 on the wedge 54.

Each biasing means 52, as shown more clearly in FIG. 3, has a first end 78 and a second end 80. Each biasing means 52 comprises a spring, preferably each spring comprises a leaf spring.

Each of the fan blade 30 root portions 42 and its respective axially extending slot 40 is provided with generally radially extending slots 90 and 92 respectively. Each radially extending slot 92 in the axially extending slot 40 in the fan rotor 28 is aligned with a corresponding radially extending slot 90 in the fan blade 30 root portion 42. Key means 94 are provided to locate in the aligned radially extending slots 90 and 92. Biasing means 96 are positioned to bias the key means 94 into a first position in which it locates in the aligned radially extending slots 90 and 92 to prevent relative axial movement between the fan blade 30 root portions 42 and the fan rotor 28 from a second position in which the key means 94 does not prevent such relative axial movement. Retention of the key means 94 in second position permits axial assembly and disassembly of the each of the fan blade 30 root portions 42 and its corresponding axially extending slot 40 in the periphery 38 of the fan rotor 28. The slider members 50 are provided to selectively lock each of the keys means 94 in the first position in the aligned radially extending slots 90 and 92.

The key means 94 is of generally U-shaped configuration and the arms of the U-shaped key means 94 locate in the aligned radially extending slots 92 and 94. One of the biasing means 96 is attached to each of the fan blade 30 root portions 42 to maintain the associated key means 94 in position on the fan blade 30 upon removal of the fan blade 30 from the fan rotor 28. The biasing means 94 comprises a metal leaf spring or a rubber band.

In order to install a fan blade 30 into the fan blade assembly 24, the U-shaped key means 94 is pressed radially inwardly in the radially extending slots 90 against the biasing means 96 to a second position. The fan blade 30 root portion 42 is then slid/pushed axially along the axially extending slot 40 in the periphery 38 of the fan rotor 28 until the radially extending slots 90 and 92 on the fan blade 30 root portion 42 and fan rotor 28 slot 40 are aligned. The U-shaped key means 94 is then biased radially outwardly to a first position into the radially extending slots 92 in the axially extending slot 40 in the fan rotor 28 by the biasing means 96 to locate the fan blade 30 axially in position.

The biasing means 52 is positioned in the slot 76 in the slider member 50 and the second end 64 of the wedge 54 is positioned in the slot 76 in the slider member 50 radially between the first end 72 of the slider member 50 and the first end 78 of the biasing means 52 such that the radial projections 60 on the wedge 54 are inserted into the axially extending slots 58 in the slider member 50. Additionally the first end 78 of the biasing means 52 is located on the second flat surface 68 of the wedge 54, as shown in FIG. 5.

The slider member 50, biasing means 52 and wedge 54 are slid/pushed together axially along the axially extending slot 40 in the fan rotor 28 radially between the fan blade 30 root portion 42 and the bottom 31 of the axially extending slot 40 until the radial projection 82 on the slider member 50 abuts the upstream surface of the rotor member 28 as shown on FIG. 5. The second end 74 of the slider member 50 locates radially between the fan blade 30 root portion 42 and the U-shaped key means 94 and the bottom 31 of the axially extending slot 40 of the fan rotor 28 to lock the U-shaped key means 94 in the first position. Additionally the biasing means 52 engages the fan blade 30 root portion 42 and the biasing means 52 becomes partially compressed.

The wedge 54 is slid/pushed axially along the axially extending slot 76 in the slider member 50 until the radial projection 84 on the first end 62 of the wedge 54 abuts the first end 72 of the slider member 50. This axial movement of the wedge 54 causes the first end 78 of the biasing means 52 to move from the second flat surface 68 along the inclined surface 70 of the wedge 54 and on to the first flat surface 66 of the wedge 54 as shown in FIG. 4. This causes the first end 78 of the biasing means 52 to move radially outwardly from a second position, the second flat surface 68, in which the biasing means 52 is in engagement with the fan blade 30 root portion 42 but is only partially compressed, into a first position, the first flat surface 66, in which the biasing means 52 is in engagement with the fan blade 30 root portion 42 and is fully compressed to at least reduce vibration of the fan blade 30 during windmilling, or slow speed operation of the turbofan gas turbine engine 10.

In order to remove a fan blade 30 from the fan blade assembly 24, the wedge 54 is pulled axially along the axially extending slot 76 in the slider member 50 until the radial projections 64 on the second end 62 of the wedge 54 abut the end of the slots 58 in the slider member 50. The wedge 54 is pulled along the axially extending slot 76 using a threaded tool, which is inserted into the threaded aperture 86 in the first end 62 of the wedge 54. This axial movement of the wedge 54 causes the first end 78 of the biasing means 52 to move from the first flat surface 66 along the inclined surface 70 of the wedge 54 and on to the second flat surface 68 of the wedge 54. This causes the first end 78 of the biasing means 52 to move radially inwardly from the first position, the first flat surface 66, in which the biasing means 52 is fully compressed and is in engagement with the fan blade 30 root portion 42 to the second position, the second flat surface 68, in which the biasing means 52 is only partially compressed and is in engagement with the fan blade 30 root portion 42.

The slider member 50, biasing means 52 and wedge 54 are pulled together axially along the axially extending slot 40 in the fan rotor 28 radially between the fan blade 30 root portion 42 and the bottom 31 of the axially extending slot 40 until they are completely removed from the axially extending slot 40 in the fan rotor 28. The slider member 50 is pulled along the axially extending slot 40 using a threaded tool, which is inserted into the threaded aperture 88 in the first end 72 of the slider member 50.

The U-shaped key means 94 is pressed radially inwardly in the radially extending slots 90 and 92 against the biasing means 96 to a second position. The fan blade 30 root portion 42 is then slid/pushed/pulled axially along the axially extending slot 40 in the periphery 38 of the fan rotor 28 until the fan blade 30 root portion 42 is completely removed from the axially extending slot 40 in the fan rotor 28.

The first and second flat surfaces 66 and 68 of the wedge 54 are substantially parallel. The first and second flat surfaces 66 and 68 are arranged substantially perpendicular to the radial direction so that in use there is no tendency for the biasing means 52 to push the wedge 54 out of the axially extending slot 76 in the slider member 50. The third surface 70 of the wedge 54 is designed so that the biasing means 52 gradually moves up the third surface 70 without jamming.

The projections 60 on the second end 64 of the wedge 54 and the slots 58 in the slider member 50 are provided to ensure that the direction of movement of the wedge 54 is in line with the biasing means 52.

Thus the slider member 50, biasing means 52 and wedge 54 chock the fan blade 30 root portion 42 in the axially extending slot 40 of the fan rotor 28.

The fan rotor 28 and the fan blades 30 are preferably formed from a suitable titanium alloy, for example 6 wt % vanadium, 4 wt % aluminium and the balance titanium plus incidental impurities.

Similarly slider member 50, the biasing means 52 and the wedge 54 are preferably formed from a suitable titanium alloy, for example 6 wt % vanadium, 4 wt % aluminium and the balance titanium plus incidental impurities.

The surfaces of the fan blade root portion, the axially extending slot in the fan rotor, the biasing means and the slider member may be provided with wear resistant coatings to minimise wear of these components during operation of the turbofan gas turbine engine.

The advantage of the present invention is that the biasing means prevents rocking movement of the fan blades in the fan rotor slots in the axial and tangential directions of the fan blade assembly during low speed operation, windmilling, and enables the biasing means to be installed and removed from the fan blade assembly. Additionally if there are wear resistant coatings on the surfaces of the biasing means, slider member, fan blade root portion or axially extending slot of the fan rotor the present invention enables the biasing means to be installed and removed from the fan blade assembly without rubbing off the wear resistant coatings.

I claim:

1. A fan blade assembly comprising a fan rotor and a plurality of circumferentially spaced radially extending fan blades, the fan rotor having a plurality of circumferentially spaced axially extending slots in the periphery of the fan rotor, each of the fan blades having a root portion which locates in one of the plurality of axially extending slots in the periphery of the fan rotor, each axially extending slot having a respective one of a plurality of slider members, each slider member being locatable between the fan blade root portion and the bottom of the axially extending slot, each axially extending slot having a respective one of a plurality of biasing means, each biasing means being locatable between the fan blade root portion and the slider member, each axially extending slot having a respective one of a plurality of wedges, each wedge being locatable between the slider member and the biasing means, each wedge being movable axially between a first position in which the wedge moves the biasing means radially outwardly into engagement with the fan blade root portion to at least reduce vibration of the fan blade and a second position in which the wedge allows the biasing means to move radially inwardly to allow assembly or disassembly of the fan blade, wherein each wedge comprises a first surface at a first end of the wedge, a second surface at the second end of the wedge, the second surface being arranged parallel to the first surface and a third inclined surface connects the first surface and the second surface and the parallel surfaces extend perpendicular to the radial direction.

2. A fan blade assembly as claimed in claim 1 wherein each wedge and respective slider member have guide means to guide the axial movement of the wedge.

3. A fan blade assembly as claimed in claim 2 wherein the guide means comprises at least one slot in the slider member and at least one projection on the wedge.

4. A fan blade assembly as claimed in claim 3 wherein the guide means comprises two parallel slots in the slider member and two projections on the wedge.

5. A fan blade assembly as claimed in claim 1 wherein each slider member comprises an axially extending groove and each biasing means locates in the axially extending groove in the respective slider member.

6. A fan blade assembly as claimed in claim 1 wherein each biasing means comprises a spring.

7. A fan blade assembly as claimed in claim 6 wherein each spring comprises a leaf spring.

8. A fan blade assembly as claimed in claim 1 wherein the first end of each slider member has means to allow the slider member to be removed from the fan blade assembly.

9. A fan blade assembly comprising a fan rotor and a plurality of circumferentially spaced radially extending fan blades, the fan rotor having a plurality of circumferentially spaced axially extending slots in the periphery of the fan rotor, each of the fan blades having a root portion which locates in one of the plurality of axially extending slots in the periphery of the fan rotor, each axially extending slot having a respective one of a plurality of slider members, each slider member being locatable between the fan blade root portion and the bottom of the axially extending slot, each axially extending slot having a respective one of a plurality of biasing means, each biasing means being locatable between the fan blade root portion and the slider member, each axially extending slot having a respective one of a plurality of wedges, each wedge being locatable between the slider member and the biasing means, each wedge being movable axially between a first position in which the wedge moves the biasing means radially outwardly into engagement with the fan blade root portion to at least reduce vibration of the fan blade and a second position in which the wedge allows the biasing means to move radially inwardly to allow assembly or disassembly of the fan blade and wherein a first end of each slider member comprises a radial projection, which abuts against the fan rotor.

10. A fan blade assembly as claimed in claim 9 wherein the first end of each wedge comprises a radial projection, which abuts against the first end of the respective slider member.

11. A fan blade assembly comprising a fan rotor and a plurality of circumferentially spaced radially extending fan blades, the fan rotor having a plurality of circumferentially spaced axially extending slots in the periphery of the fan rotor, each of the fan blades having a root portion which locates in one of the plurality of axially extending slots in the periphery of the fan rotor, each axially extending slot having a respective one of a plurality of slider members, each slider member being locatable between the fan blade root portion and the bottom of the axially extending slot, each axially extending slot having a respective one of a plurality of biasing means, each biasing means being locatable between the fan blade root portion and the slider member, each axially extending slot having a respective one of a plurality of wedges, each wedge being locatable between the slider member and the biasing means, each wedge being movable axially between a first positing in which the wedge moves the biasing means radially outwardly into engagement with the fan blade root portion to at least reduce vibration of the fan blade and a second position in which the wedge allows the biasing means to move radially inwardly to allow assembly or disassembly of the fan blade wherein the first end of each wedge has means to allow the wedge to be removed from the fan blade assembly.

12. A fan blade assembly comprising a fan rotor and a plurality of circumferentially spaced radially extending fan blades, the fan rotor having a plurality of circumferentially spaced axially extending slots in the periphery of the fan rotor, each of the fan blades having a root portion which locates in one of the plurality of axially extending slots in the periphery of the fan rotor, each axially extending slot having a respective one of a plurality of slider members, each slider member being locatable between the fan blade root portion and the bottom of the axially extending slot, each axially extending slot having a respective one of a plurality of biasing means, each biasing means being locatable between the fan blade root portion and the slider member, each axially extending slot having a respective one of a plurality of wedges, each wedge being locatable between the slider member and the biasing means, each wedge being movable axially between a first position in which the wedge moves the biasing means radially outwardly into engagement with the fan blade root portion to at least reduce vibration of the fan blade and a second position in which the wedge allows the biasing means to move radially inwardly to allow assembly or disassembly of the fan blade wherein each of the fan blade root portions and its respective axially extending slot being provided with generally radially extending slots, each radially extending slot in the axially extending slot in the fan rotor being aligned with a corresponding radially extending slot in the fan blade root portion, key means being provided to locate in the aligned radially extending slots, biasing means being positioned to bias the key means into a first position in which it locates in the aligned radially extending slots to prevent relative axial movement between the fan blade root portions and the fan rotor from a second position in which the key means does not prevent such relative axial movement, whereby retention of the key means in second position permits axial assembly and disassembly of the each of the fan blade root portions and its corresponding axially extending slot in the periphery of the fan rotor, the slider member being provided to selectively lock each of the keys in the first position in the aligned radially extending slots.

13. A fan blade assembly as claimed in claim 12 wherein the key means is of generally U-shaped configuration, the arms of the U-shaped key means locating in the aligned radially extending slots.

14. A fan blade assembly as claimed in claim 12 wherein one of the biasing means is attached to each of the fan blade root portions to maintain the associated key means in position on the fan blade upon removal of the fan blade from the fan rotor.

15. A fan blade assembly as claimed in claim 14 wherein the biasing means comprises a leaf spring.

16. A fan blade assembly as claimed in claim 15 wherein the biasing means is formed from spring steel or rubber.

17. A fan blade assembly comprising a fan rotor and a plurality of circumferentially spaced radially extending fan blades, the fan rotor having a plurality of circumferentially spaced axially extending slots in the periphery of the fan rotor, each of the fan blades having a root portion which locates in one of the plurality of axially extending slots in the periphery of the fan rotor, each axially extending slot having a respective one of a plurality of slider members, each slider member being locatable between the fan blade root portion and the bottom of the axially extending slot, each axially extending slot having a respective one of a plurality of biasing means, each biasing means being locatable between the fan blade root portion and the slider member, each axially extending slot having a respective one of a plurality of wedges, each wedge being locatable between the slider member and the biasing means, each wedge comprises a first surface at a first end of the wedge, a second surface at the second end of the wedge, the second surface is arranged parallel to the first surface and a third inclined surface connects the first surface and the second surface, each wedge being moveable axially between a first axial position in which the biasing means is at a first radial position in engagement with the fan blade root portion to at least reduce vibration of the fan blade and a second axial position in which the biasing means is at a second radial position to allow assembly or disassembly of the fan blade, the biasing means abuts the first surface of the wedge in the first axial position of the wedge and abuts the second surface of the wedge in the second axial position of the wedge.

* * * * *